US009022748B2

(12) United States Patent
Hirata et al.

(10) Patent No.: US 9,022,748 B2
(45) Date of Patent: May 5, 2015

(54) SCREW COMPRESSOR

(75) Inventors: Kazuya Hirata, Kako-gun (JP); Shoji Yoshimura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 274 days.

(21) Appl. No.: 13/296,694

(22) Filed: Nov. 15, 2011

(65) Prior Publication Data

US 2012/0156079 A1 Jun. 21, 2012

(30) Foreign Application Priority Data

Dec. 15, 2010 (JP) ..... 2010-279279

(51) Int. Cl.
*F04B 39/00* (2006.01)
*F04C 18/16* (2006.01)
*F04C 28/06* (2006.01)

(52) U.S. Cl.
CPC ..... *F04C 18/16* (2013.01); *F04C 28/06* (2013.01)

(58) Field of Classification Search
CPC ..... F04C 18/16; F04C 28/06
USPC ..... 417/18, 20, 22, 44.1, 45, 223, 63; 418/201.1, 69, 2, 14; 192/84.96, 30 W
See application file for complete search history.

(56) References Cited

U.S. PATENT DOCUMENTS 2,935,247 A * 5/1960 Trulsson ..... 418/203
4,413,314 A * 11/1983 Slater et al. ..... 700/83
4,616,742 A * 10/1986 Matsushita ..... 192/84.94
5,377,649 A * 1/1995 Matsubara et al. ..... 123/559.1
5,401,149 A * 3/1995 Tsuru et al. ..... 418/178
6,599,093 B2 7/2003 Totsuka
7,118,348 B2 * 10/2006 Dean et al. ..... 417/12
2004/0175273 A1 9/2004 Dean et al.

FOREIGN PATENT DOCUMENTS

CN 101248277 A 8/2008
EP 460578 A1 * 12/1991 ..... F01C 21/06
EP 482592 A1 * 4/1992 ..... F04B 49/08
JP 61-123897 U 8/1986
JP 3837278 8/2006

OTHER PUBLICATIONS

Japanese Office Action issued Jan. 8, 2013 in Patent Application No. 2010-279279 with English Translation.

* cited by examiner

*Primary Examiner* — Devon Kramer
*Assistant Examiner* — Joseph Herrmann
(74) *Attorney, Agent, or Firm* — Oblon, McClelland, Maier & Neustadt, L.L.P.

(57) ABSTRACT

A screw compressor including a driving machine having an output shaft coupled to an input shaft of a compressor main body; a clutch mechanism between the output shaft of the driving machine and the input shaft of the compressor main body; a pressure sensor installed in a discharge channel; and a controller that controls the switching of the clutch mechanism between an engaged state and a disengaged state based on a discharge pressure value detected by the pressure sensor is disclosed. When the discharge pressure value becomes higher than an unload set value that is predetermined, the controller controls the clutch mechanism to be switched to the disengaged state. According to the above screw compressor, power losses are reduced even when the supply of compressed gas is hardly required.

8 Claims, 1 Drawing Sheet

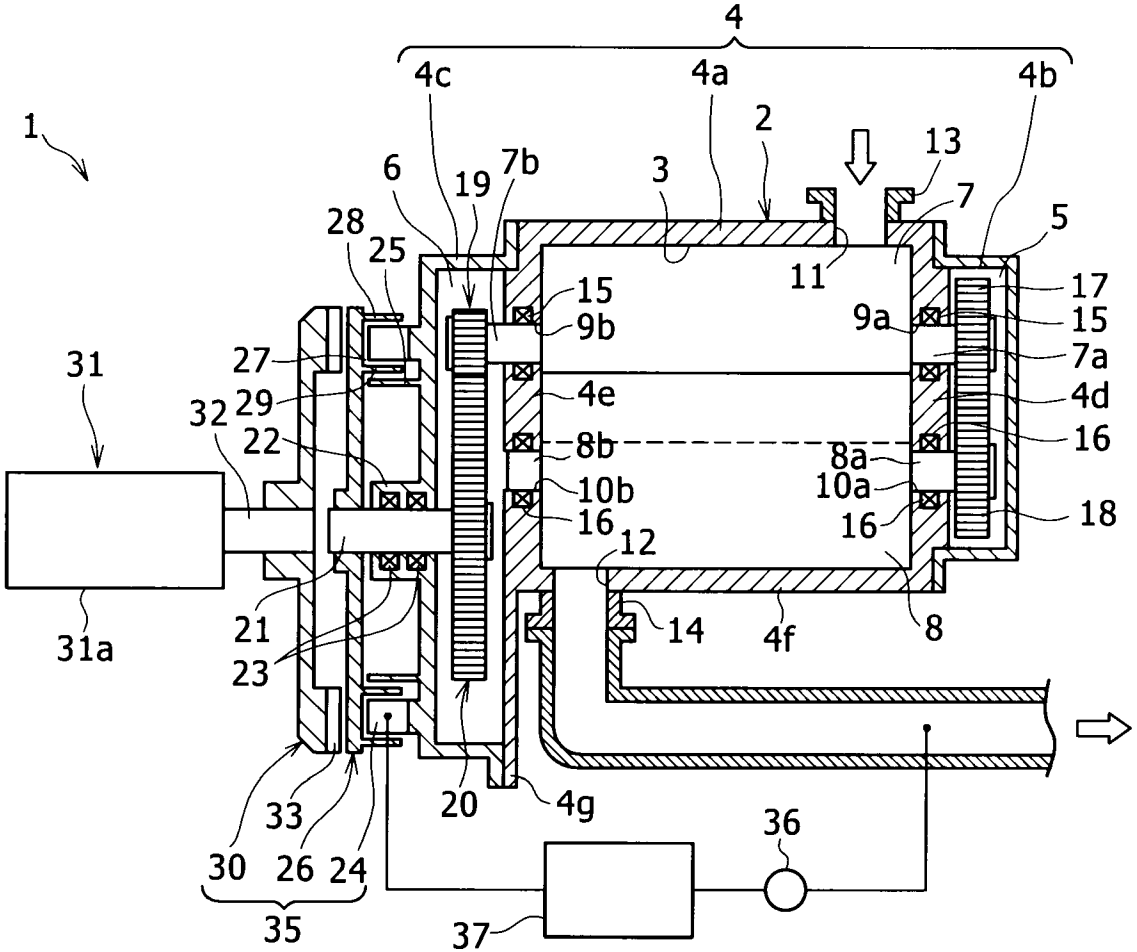
1
2
3
4
4a
4b
4c
4d
4e
4f
4g
5
6
7
7a
7b
8
8a
8b
9a
9b
10a
10b
11
12
13
14
15
16
17
18
19
20
21
22
23
24
25
26
27
28
29
30
31
31a
32
33
35
36
37

SCREW COMPRESSOR

BACKGROUND OF THE INVENTION

1. Field of the Invention

The present invention relates to a screw compressor, especially relates to a screw compressor that effectively reduces power losses during unload operation.

2. Description of the Related Art

For a compressor equipped with a suction adjustment valve on the suction side of a compressor main body and a gas release valve on the discharge side thereof, the discharge capacity is adjusted by load/unload control operation in which when the pressure on the discharge side becomes high, the suction adjustment valve is closed and the gas release valve is opened, and when the pressure on the discharge side becomes low, the suction adjustment valve is opened and the gas release valve is closed.

However, the above compressor cannot completely close a suction channel with the suction adjustment valve, even in case of unload operation in which compressed gas is not required on the consuming side. When the suction channel is closed, the compression ratio becomes infinite, and the temperature of discharged gas increases. As a result, the operation cannot be continued, and, in the worst case, the compressor main body is damaged. Thus, even in the unload operation, the suction adjustment valve cannot be completely closed, and 20 to 30% of the power that is consumed in load operation is unfortunately wasted.

Thus, various methods for operating compressor have been proposed to solve problems such as the prevention of excessive increase of gas temperature on the discharge side, and the reduction of power losses in unload operation.

For example, Japanese Patent No. 3837278 discloses a method for operating compressor, in which when rotation speed of a motor for driving a compressor main body is higher than a set value that is predetermined, the rotation speed of the motor is controlled by opening a suction adjustment valve on the suction side so that the rotation speed is reduced based on detected values of a pressure sensor on the discharge side. When the rotation speed reaches the set value, the control of the rotation speed is stopped and switched to the other control in which the suction adjustment valve is opened or closed in response to the pressure variation on the discharge side so that the pressure variation on the discharge side is suppressed.

According to this method for operating compressor, the prevention of excessive increase of temperature on the discharge side and reduction of power losses can be realized.

However, there is room for improvement in the reduction of power losses under a state in which the supply of compressed gas is hardly required.

SUMMARY OF THE INVENTION

It is an object of the present invention to provide a screw compressor that reduces power losses under a state in which the supply of compressed gas is hardly required.

To solve the above problems, the present invention provides a screw compressor including: a compressor main body having a compression chamber accommodating a pair of male and female screw rotors, and a casing having a suction port and a discharge port that communicate with the compression chamber, wherein an input shaft for rotating one of the pair of male and female screw rotors protrudes out of the casing; and a discharge channel connected to the discharge port of the compressor main body, the screw compressor, including: a driving machine having an output shaft coupled to the input shaft; a clutch mechanism switched between an on-state in which the output shaft of the driving machine and the input shaft of the compressor main body are connected, and an off-state in which the output shaft of the driving machine and the input shaft of the compressor main body are disconnected; a pressure sensor installed in the discharge channel; and a controller that controls the switching of the clutch mechanism between the on-state and the off-state based on a discharge pressure value detected by the pressure sensor, wherein when the discharge pressure value becomes higher than an unload set value that is predetermined, the controller controls the clutch mechanism to be switched to the off-state.

According to this configuration, when a discharge pressure value detected by the pressure sensor becomes higher than a unload set value that is predetermined, the controller controls the clutch mechanism to be switched to the off-state. When the clutch mechanism is switched to the off-state, the connection between the output shaft of the driving machine and the input shaft of the compressor main body is disconnected. Consequently, when the supply of compressed gas is hardly required, the driving machine and the screw rotor which is the target to be driven by the driving machine are completely disconnected. That is, even if the driving machine continues to be operated, it can be operated under almost no load. Thus, the electric power consumption and power losses are reduced.

It is preferable that when the discharge pressure value becomes equal to or less than a value slightly lower than the unload set value, the controller switches the clutch mechanism from the off-state to the on-state. Alternatively, it is preferable that when the clutch mechanism is switched to the on-state or the off-state, the controller maintains the switched state of the clutch mechanism until a predetermined time period passes from the time of the switching. According to these configurations, when the discharge pressure value becomes equal to or less than a value slightly lower than the unload set value, the controller switches the clutch mechanism from the off-state to the on-state, or when the clutch mechanism is switched to the on-state or the off-state, the controller maintains the switched state until a predetermined time period passes from the time of the switching. Thus, frequent occurrences of connection and disconnection of the clutch mechanism can be avoided.

It is preferable that the screw compressor further includes a means that counts the number of times that the clutch mechanism is switched to the on-state except for the switching to the on-state at start-up, and gives an alarm when the number of counted times exceeds a predetermined threshold. According to this configuration, since an alarm is generated when the number of counted times of the connections of the clutch mechanism exceeds the predetermined threshold, the clutch mechanism is prevented from experiencing excessive wear.

BRIEF DESCRIPTION OF THE DRAWINGS

FIG. 1 is a schematic cross-sectional view of a screw compressor according to the present invention.

DETAILED DESCRIPTION OF THE PREFERRED EMBODIMENTS

An embodiment of the present invention is now described with reference to the accompanying drawing.

FIG. 1 shows a screw compressor 1 according to the present invention. The screw compressor 1 includes a compressor main body 2, a clutch mechanism 35, a motor (driving machine) 31 and a controller 37.

The compressor main body 2 includes a casing 4. The casing 4 includes: a main casing 4*a*, in which a compression chamber 3 is formed; an end cover 4*b* for synchronizing gears, which is mounted to one side of the main casing 4*a* to form a gear compartment 5 between the end cover 4*b* and the main casing 4*a*; and an end cover 4*c* for transmission, which is mounted to the other side of the main casing 4*a* to form a gear compartment 6 between the end cover 4*c* and the main casing 4*a*.

In the compression chamber 3 of the main casing 4*a*, a male screw rotor 7 and a female screw rotor 8 that are engaged with each other are rotatably accommodated.

A rotor shaft 7*a* extends from the male screw rotor 7 into the gear compartment 5 through a through hole 9*a* in a dividing wall 4*d* located between the compression chamber 3 and the gear compartment 5. A rotor shaft 7*b* extends from the male screw rotor 7 into the gear compartment 6 through a through hole 9*b* in a dividing wall 4*e* located between the compression chamber 3 and the gear compartment 6.

A rotor shaft 8*a* extends from the female screw rotor 8 into the gear compartment 5 through a through hole 10*a* in the dividing wall 4*d* located between the compression chamber 3 and the gear compartment 5. A rotor shaft 8*b* extends from the female screw rotor 8 into the gear compartment 6 through a through hole 10*b* in the dividing wall 4*e* located between the compression chamber 3 and the gear compartment 6.

A suction port 11 is provided in a side wall 4*f* of the compression chamber 3 on the side of the gear compartment 5, and a discharge port 12 is provided in the side wall 4*f* on the side of the gear compartment 6. The suction port 11 and the discharge port 12 both communicate with the compression chamber 3. A suction channel 13 is connected to the suction port 11. A discharge channel 14 is connected to the discharge port 12.

The rotor shafts 7*a* and 7*b* of the male screw rotor 7 are supported with bearings 15 and 15 in the dividing walls 4*d* and 4*e*. The rotor shafts 8*a* and 8*b* of the female screw rotor 8 are supported with bearings 16 and 16 in the dividing walls 4*d* and 4*e*.

The dividing wall 4*e* on the side of the female screw rotor 8 is provided with an expansion part 4*g* that expands radially outward beyond the side wall 4*f* so that a speed increaser mentioned below is accommodated.

An end part of the rotor shaft 7*a* in the gear compartment 5 is provided with a synchronizing gear 17. An end part of the rotor shaft 8*a* in the gear compartment 5 is provided with a synchronizing gear 18. The synchronizing gear 17 and the synchronizing gear 18 are configured to rotatably engage with each other.

A pinion gear (small gear) 19 is coupled to an end of the rotor shaft 7*b* in the gear compartment 6. The pinion gear 19 is configured to rotatably engage with a pull gear (large gear) 20. The pinion gear 19 and the pull gear 20 in the gear compartment 6 form the speed increaser.

An input shaft 21 is coupled with the axial center of the pull gear 20. The input shaft 21 protrudes out of the casing 4 through a boss 22 of the end cover 4*c* for transmission. The boss 22 faces in a direction away from the compression chamber 3. The input shaft 21 is supported with bearings 23 and 23 in the boss 22. A main body-side disk rotor 26 to be mentioned later is coupled to an end of the input shaft 21. The input shaft 21 having the pull gear 20 is configured to rotate together with the main body-side disk rotor 26.

An actuation part 24 including an electromagnetic coil is provided on a surface of the end cover 4*c* for transmission which faces the main body-side disk rotor 26. The actuation part 24 protrudes in the same direction as the direction the input shaft 21 protrudes such that an end of the actuation part 24 is located close to the outer edge of a surface of the main body-side disk rotor 26 which faces the end cover 4*c* for transmission. Voltage application to the actuation part 24 is controlled by the controller 37.

Radially inside the actuation part 24, a guide part 25 is provided such that it is concentric with the boss 22. The guide part 25 guides the rotation of the main body-side disk rotor 26 by regulating the radial movement of a housing 27 for actuation part of the main body-side disk rotor 26, which is mentioned below.

The main body-side disk rotor 26 is made of a magnetizable metal. The main body-side disk rotor 26 includes the housing 27 for actuation part on the outer edge of its surface which faces the end cover 4*c* for transmission. The housing 27 for actuation part includes an outer diameter part 28 and an inner diameter part 29, each protruding from the main body-side disk rotor 26 toward the end cover 4*c* for transmission. The housing 27 for actuation part accommodates the actuation part 24 such that the end of the actuation part 24 of the end cover 4*c* for transmission is located close to the main body-side disk rotor 26 between the outer diameter part 28 and the inner diameter part 29.

A driving machine-side disk rotor 30 is provided so as to face the main body-side disk rotor 26. The driving machine-side disk rotor 30 has the same outer diameter as that of the main body-side disk rotor 26. The end of an output shaft 32 of a motor 31 that protrudes from a motor body (driving machine body) 31*a* is coupled to the axial center of the driving machine-side disk rotor 30.

An armature 33 is joined to the driving machine-side disk rotor 30 via a flat spring (elastic member) not shown such that the armature 33 faces a surface of the main body-side disk rotor 26 on which the housing 27 for actuation part is not provided.

The driving machine-side disk rotor 30, the main body-side disk rotor 26 and the actuation part 24 constitute a clutch mechanism 35. The clutch mechanism 35 is switched between an on-state in which the output shaft 32 of the motor 31 and the input shaft 21 of the compressor main body 2 are connected via the driving machine-side disk rotor 30 and the main body-side disk rotor 26, and an off-state in which the output shaft 32 of the motor 31 and the input shaft 21 of the compressor main body 2 are disconnected. The clutch mechanism 35 is installed between the motor 31 and the compressor main body 2. In other words, the rotational force from the motor 31 is transmitted to the synchronizing gear 17 via the clutch mechanism 35, the input shaft 21, the speed increaser and the rotor shafts 7*b* and 7*a*, the synchronizing gear 18 is caused to rotate with the rotation of the synchronizing gear 17, and both the male screw rotor 7 and the female screw rotor 8 rotate.

The controller 37 controls voltage application to the actuation part 24 and individual components, based on signals related to the pressure Pd of discharge gas detected by a pressure sensor 36 installed in the discharge channel 14 of the screw compressor 1.

The controller 37 is provided with an input device (not shown) such as a touch screen. With the input device, an unload set value Pd_unload that is mentioned below can be set to any value within a range between an upper limit and a lower limit that are predetermined.

Now, the operation of the screw compressor 1 with the above configuration is explained.

When the screw compressor 1 is started, the energization of the actuation part 24 is started by the controller 37. When the actuation part 24 is energized and applied with voltage, the actuation part 24 generates magnetic flux. The magnetic flux magnetizes the main body-side disk rotor 26. The main body-side disk rotor 26 pulls the armature 33 against the restitution force of the flat spring. Then, the main body-side disk rotor 26 comes in contact with the armature 33, connecting the main body-side disk rotor 26 to the driving machine-side disk rotor 30. In other words, the clutch mechanism 35 is connected and switched to the on-state. As a result, the rotational force of the motor 31 is transmitted to the main body-side disk rotor 26 and the input shaft 21 via the output shaft 32, the driving machine-side disk rotor 30 and the armature 33. The rotational force of the input shaft 21 is transmitted to the speed increaser, the male screw rotor 7 and the female screw rotor 8, and the screw compressor 1 is actually activated as an compressor.

When the screw rotors 7 and 8 rotate, the compressor main body 2 sucks fluid to be compressed from the suction port 11 through the suction channel 13. The compressor main body 2 compresses the fluid in the compression space in the compression chamber 3, discharges the fluid from the discharge port 12, and supplies the fluid to a supply destination (not show) through the discharge channel 14.

In the discharge channel 14, the pressure Pd of the discharge gas is detected by the pressure sensor 36. Signals related to the pressure Pd of the discharge gas are sent to the controller 37. The controller 37 controls voltage application to the actuation part 24 and individual components, based on the received signals related to the pressure Pd of the discharge gas.

When the pressure Pd of the discharge gas detected by the pressure sensor 36 becomes higher than the unload set value Pd_unload, the controller 37 stops energizing the actuation part 24. Due to this, the magnetic flux of the actuation part 24 disappears. The disappearance of the magnetic flux causes the main body-side disk rotor 26 to be demagnetized. In the driving machine-side disk rotor 30, the armature 33 returns to the initial position by the restitution force of the flat spring. In other words, the armature 33 is disconnected from the main body-side disk rotor 26, that is, the main body-side disk rotor 26 is disconnected from the driving machine-side disk rotor 30 so that the clutch mechanism 35 is disconnected and switched to the off-state.

When the clutch mechanism 35 is disconnected, the rotations of the screw rotors 7 and 8 stop, and the pressure in the discharge channel 14 decreases with the supply of the discharge gas to a supply destination.

When the pressure Pd of the discharge gas detected by the pressure sensor 36 becomes equal to or less than a value slightly lower than the unload set value Pd_unload, the controller 37 resumes the energization of the actuation part 24, and the clutch mechanism 35 is connected and switched to the on-state.

In the present embodiment, the clutch mechanism 35 is re-connected, not when the pressure Pd of the discharge gas becomes equal to or less than the unload set value Pd_unload, but when the pressure Pd of the discharge gas becomes equal to or less than a value slightly lower than the unload set value Pd_unload. The reason is that it is intended to avoid frequent occurrences of connection and disconnection of the clutch mechanism 35 when the pressure Pd of the discharge gas is close to the unload set value Pd_unload.

According to such a configuration, when the supply of compressed gas is hardly required (when the pressure Pd of the discharge gas detected by the pressure sensor 36 is higher than the unload set value Pd_unload), the driving machine and the screw rotors 7 and 8, which are the targets to be driven by the driving machine, are completely disconnected. Thus, even if the operation of driving machine is continued, the operation is performed under almost no load. Therefore, the electric power consumption and power losses are reduced.

In addition, when the driving machine is a motor 31, heat generation of the motor 31 can be suppressed. Thus, according to the screw compressor 1, the motor 31 can be more quickly cooled than conventional operation with cooling air generated by a fan installed in the motor 31. As a result, since the cooling time of the motor 31 becomes shorter, start/stop time of the motor 31 can be reduced, which is advantageous also to the compressor.

It is preferable that the controller 37 counts the number of times that the clutch mechanism 35 is connected except for the connection at start-up, that is, the number of times that the clutch mechanism 35 is switched to the on-state, and the controller 37 gives an alarm indicating "Do the maintenance for the clutch mechanism" with an alarm means not shown (e.g., display) when the number of times exceeds a predetermined threshold. The controller 37 thus prevents the clutch mechanism 35 from experiencing excessive wear or the like.

The present invention is not limited to the embodiment, but various modifications are possible. For example, when the clutch mechanism 35 is switched to the on-state or off-state, the controller 37 may maintain the switched state (on-state or off-state) of the clutch mechanism 35, regardless of variation of the pressure Pd of the discharge gas, for a predetermined time period (e.g., 23 sec.) from the time of the switching. This configuration also prevents frequent occurrences of connection and disconnection of the clutch mechanism 35.

In addition, instead of the clutch mechanism 35 having the armature 33 and the actuation part 24 including an electromagnetic coil, another clutch mechanism such as a clutch mechanism that uses an actuator to switch the connection and disconnection between the driving machine-side disk rotor 30 and the main body-side disk rotor 26 may be employed, for example. Furthermore, a speed increaser may be omitted, the rotor shaft **7*b* of the male screw rotor 7 or the rotor shaft 8*b* of the female screw rotor 8 may be configured to protrude out of the casing 4, and the protruding rotor shaft may be used as the input shaft 21**. Further, the driving machine may be an engine.

What is claimed is:

1. A screw compressor including: a compressor main body having a compression chamber accommodating a pair of male and female screw rotors, and a casing having a suction port and a discharge port that communicate with the compression chamber, wherein an input shaft for rotating one of the pair of male and female screw rotors protrudes out of the casing; and a discharge channel connected between the discharge port of the compressor main body and a supply destination, the screw compressor, comprising:

a driving machine having an output shaft coupled to the input shaft;

a clutch mechanism switched between an on-state in which said output shaft of said driving machine and the input shaft of the compressor main body are connected, and an off-state in which said output shaft of said driving machine and the input shaft of the compressor main body are disconnected;

a pressure sensor installed in the discharge channel; and a controller that controls the switching of said clutch mechanism between the on-state and the off-state based on a discharge pressure value detected by said pressure sensor in the discharge channel, wherein when the discharge pressure value becomes higher than an unload set value that is predetermined, said controller controls said clutch mechanism to be switched to the off-state, wherein said controller counts a number of times that said clutch mechanism is switched to the on-state except for the switching to the on-state at start-up of the screw compressor, and generates an alarm when the counted number of times exceeds a predetermined threshold, and wherein when said clutch mechanism is switched to the on-state or the off-state, said controller maintains said clutch mechanism in the on-state or the off-state, respectively, until a predetermined time period passes from the time of the switching.

2. The screw compressor of claim 1, wherein when the discharge pressure value becomes equal to or less than a value slightly lower than the unload set value, said controller switches said clutch mechanism from the off-state to the on-state.

3. The screw compressor of claim 1, wherein said controller includes an input device to set the unload set value.

4. The screw compressor of claim 3, wherein the input device is a touch screen.

5. The screw compressor of claim 1, wherein said driving machine is a motor.

6. The screw compressor of claim 1, wherein said casing has an end cover, the end cover including an actuation part having an electromagnetic coil provided on a surface of the end cover.

7. The screw compressor of claim 6, wherein the controller applies a voltage to the actuation part during the on-state such that the actuation part generates a magnetic flux.

8. The screw compressor of claim 1, wherein the predetermined time period is 23 seconds.

* * * * *